United States Patent [19]

Coad

[11] Patent Number: 4,536,215

[45] Date of Patent: Aug. 20, 1985

[54] BORON ADDITION TO ALLOYS

[75] Inventor: Brian C. Coad, San Francisco, Calif.

[73] Assignee: GTE Products Corporation, Stamford, Conn.

[21] Appl. No.: 680,106

[22] Filed: Dec. 10, 1984

[51] Int. Cl.[3] ..... C22B 23/00

[52] U.S. Cl. ..... 75/129; 75/53; 75/82

[58] Field of Search ..... 75/53, 82, 129, 130 R

[56] References Cited

U.S. PATENT DOCUMENTS

| | | | |
|---|---|---|---|
| 2,528,867 | 11/1950 | Day | 75/129 |
| 3,754,899 | 8/1973 | Kanter | 75/129 |
| 3,948,648 | 4/1976 | Meichsner | 75/53 |
| 4,124,378 | 11/1978 | Kurdowski | 75/53 |
| 4,175,950 | 11/1979 | Linares | 75/53 |
| 4,440,568 | 4/1984 | Staggers | 75/53 |

*Primary Examiner*—Peter D. Rosenberg
*Attorney, Agent, or Firm*—Donald R. Castle

[57] ABSTRACT

A process for addition of boron to an alloy which involves forming a melt of the alloy and a reactive metal, selected from the group consisting of aluminum, titanium, zirconium and mixtures thereof to the melt, maintaining the resulting reactive mixture in the molten state and reacting the boric oxide with the reactive metal to convert at least a portion of the boric oxide to boron which dissolves in the resulting melt, and to convert at least portion of the reactive metal to the reactive metal oxide, which oxide remains with the resulting melt, and pouring the resulting melt into a gas stream to form a first atomized powder which is subsequently remelted with further addition of boric oxide, re-atomized, and thus reprocessed to convert essentially all the reactive metal to metal oxide to produce a powdered alloy containing specified amounts of boron.

4 Claims, No Drawings

BORON ADDITION TO ALLOYS

FIELD OF THE INVENTION

This invention relates to a method for addition of boron to alloys. More particularly, it relates to a method of addition of boron to an alloy by the reduction of boric oxide with a reactive metal.

BACKGROUND OF THE INVENTION

In the preparation of ferrous metal alloy powders containing substantial amounts of boron, that is, from about 0.5% to about 5% by weight typically, boron is added to the melt as a master alloy of ferroboron or nickel boron. Such alloys, typically containing from about 15% to about 20% by weight boron are expensive, making boron by far the most expensive component, commonly amounting to about 15% to about 20% of raw material cost in an alloy containing about 3% boron by weight.

Consequently, a method of introducing boron into the alloy which avoids the master alloy would be an advancement in the art.

U.S. Pat. No. 2,866,688 describes a process for producing amorphous boron of high purity, that is free of boron suboxides. The process as described use magnesium and does not address the needs filled by the present invention since it does not disclose the production of ferrous metal alloys containing boron.

SUMMARY OF THE INVENTION

In accordance with one aspect of this invention, there is provided a process for the addition of boron to an alloy which involves forming a melt of the alloy and a reactive metal selected from the group consisting of Al, Ti, Zr and mixtures thereof, adding a charge of boric oxide to a melt maintaining the resulting reactive mixture in the molten state thereby reacting at least a portion of boric oxide with the reactive metal to thereby convert at least a portion of the charge of boric oxide to boron which dissolves in the resulting melt, and to convert at least a portion of the reactive metal to the reactive metal oxide essentially all of which oxide remains with the resulting slag phase, removing the resulting slag phase from the resulting melt, and atomizing the resulting melt into droplets and cooling the droplets to form an alloy powder.

DETAILED DESCRIPTION OF THE INVENTION

For a better understanding of the present invention, together with other and further objects, advantages, and capabilities thereof, reference is made to the following disclosure and appended claims in connection with the foregoing description of some of the aspects of the present invention.

This invention relates to a method for addition of boron to an alloy by reduction of boric oxide with a reactive metal during the normal processing of the alloy.

The alloy generally is a nickel or iron based alloy. The alloy generally in powder form is mixed with a reactive metal and melted. A typical composition of the melt is as follows, by weight: from 0% to about 10% silicon, from 0% to about 20% chromium, from about 0% to about 5% iron, from about 3% to about 10% of a reactive metal, and the balance nickel. The reactive metal can be aluminum, titanium, or zirconium with aluminum being preferred because of its intrinsic low cost and relatively higher production of boron per unit weight of metal.

The melt is formed by melting the components in a crucible. The charge of boric oxide is commonly added as a slag to protect the metallic materials from oxidizing during melting. The amount of boric oxide added is in excess of the stoichiometric amount required to carry the reaction to completion. The temperature of the above reactive mixture is sufficient to maintain the mixture in the molten state throughout the course of the reaction. When aluminum is the reactive metal, temperatures are generally from about 1150° C. to about 1300° C. with from about 1200° C. to about 1250° C. being preferred.

In the reaction that takes place, the reactive metal reacts with a portion of the first charge of boric oxide to form elemental boron which dissolves in the resulting first reacted melt and to form a reactive metal oxide essentially all of which remains with the first resulting slag phase. This slag phase which consists essentially of the unreacted boric oxide and reactive metal oxide is then removed from the first reacted melt which consists essentially of the alloy with boron and essentially all of the unreacted reactive metal, by being skimmed off the reacted melt.

The first reacted melt is atomized generally with an inert gas stream to form droplets which are cooled to form an atomized powder. While it is possible to carry the reaction to near completion, that is, to the point at which the atomized powder is almost free of aluminum, and boron has been gained proportionately, it is difficult to maintain sufficiently intimate contact between molten alloy and molten boric oxide to bring the reaction to completion in reasonable time. Thus the analysis of the first atomized powder given above shows a typical composition by weight of a atomized powder in which aluminum is the reactive metal is given below: About 4.00% silicon, about 6.67% chromium, about 3.43% iron, about 3.71% aluminum, about 1.36% boron and the balance nickel. The initial charge includes 7% aluminum.

Therefore, a second melt of the first atomized powder is formed. A second charge of boric oxide is preblended with the atomized powder and melted therewith, giving an intimate mixture of metal and slag. The amount of boric oxide which is added is in excess of that sufficient to convert the remainder of the reactive metal to reactive metal oxide and correspondingly to raise the boron in the powder to the desired level. The temperature of the above second reactive mixture is sufficient to maintain the mixture in the molten state throughout the course of the reaction, as described previously for the first reaction.

The second charge of boric oxide reacts with the remaining portion of the reactive metal in the second melt to convert essentially all of the reactive metal to reactive metal oxide which remains with the second resulting slag phase while converting a portion of the second charge of boric oxide to boron, which remains with the resulting second reacted melt.

The second resulting slag phase is then removed from the second reacted melt as described previously for the first reaction.

The second reacted melt is then poured into a gas stream to form a second atomized powder.

When the first atomized powder of the composition given previously is subjected to the remelt and the reaction described above, the second atomized powder has the following typical composition by weight: about 4.35% silicon, about 7.44% chromium, about 2.96% iron, about 2.92% boron, about 0.03% aluminum and the balance nickel. This analysis is within the specification of AMS-4777 A which is, by weight: from about 4.0% to about 5.0% silicon, from about 6.0% to about 8.0% chromium, from about 2.5% to about 3.5% iron, from about 2.75% to about 3.5% boron, and the balance nickel with aluminum no greater than about 0.05%.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for addition of boron to an iron or nickel base alloy, said process comprising:

(a) forming a melt of said alloy and a reactive metal selected from the group consisting of aluminum, titanium and zirconium, (b) adding a charge of boric oxide to said melt to form a reactive mixture, (c) maintaining said reactive mixture in the molten state thereby reacting at least a portion of said boric oxide with said reactive metal to convert at least a portion of said first charge of boric oxide to boron which dissolves in the resulting melt, and to convert at least a portion of said reactive metal to the reactive metal oxide essentially all of which oxide forms a separate slag phase, (d) removing said slag phase from said resulting melt and, (e) atomizing said resulting first melt into droplets and, (f) cooling the atomized droplets to form a powder.

2. A process according to claim 1 comprising the additional steps:

(a) blending the atomized powder with boric oxide (b) forming an additional melt of the atomized powder-boric oxide mixture to form a second reactive mixture, (c) maintaining said second reactive mixture in the molten state thereby reacting the boric oxide with the remaining portion of the reactive metal in the additional melt to thereby convert essentially all of the reactive metal to the reactive metal oxide which forms a separate slag phase while converting a portion of said second charge of boric oxide to boron, which remains with the resulting second reacted melt, (d) removing said slag phase from the resulting melt and, (e) atomizing the melt into droplets and, (f) cooling the droplets to form an alloy powder containing boron.

3. A process according to claim 1 or 2 wherein said melt consists essentially of, by weight: from about 3% to about 5% silicon, from about 6% to about 15% chromium, from about 2.5% to about 5.0% iron, from about 5% to about 10% of a reactive metal, and the balance nickel.

4. A process according to claim 1 or 2 wherein said melt consists essentially of, by weight: from about 3% to about 5% silicon, from about 5% to about 10% of a reactive metal, and the balance nickel.

* * * * *